US008955584B2

(12) United States Patent
Telfer

(10) Patent No.: US 8,955,584 B2
(45) Date of Patent: Feb. 17, 2015

(54) DRILL STRING MOUNTED ROTATABLE TOOL AND CLEANING METHOD

(75) Inventor: George Telfer, Aberdeen (GB)

(73) Assignee: Specialised Petroleum Services Group Limited, Aberdeen (GB)

( * ) Notice: Subject to any disclaimer, the term of this patent is extended or adjusted under 35 U.S.C. 154(b) by 616 days.

(21) Appl. No.: 13/056,276

(22) PCT Filed: Aug. 6, 2009

(86) PCT No.: PCT/GB2009/050986

§ 371 (c)(1),
(2), (4) Date: Apr. 15, 2011

(87) PCT Pub. No.: WO2010/015861

PCT Pub. Date: Feb. 11, 2010

(65) Prior Publication Data

US 2011/0186355 A1 Aug. 4, 2011

(30) Foreign Application Priority Data

Aug. 7, 2008 (GB) ..... 0814456.0

(51) Int. Cl.
*E21B 37/00* (2006.01)
*E21B 37/02* (2006.01)

(52) U.S. Cl.
CPC ..... *E21B 37/02* (2013.01)
USPC ..... 166/173; 166/311

(58) Field of Classification Search
USPC ..... 166/311, 173; 175/325.1, 325.5, 328
See application file for complete search history.

(56) References Cited

U.S. PATENT DOCUMENTS

| | | | | |
|---|---|---|---|---|
| 6,189,618 | B1 * | 2/2001 | Beeman et al. | 166/312 |
| 6,253,861 | B1 | 7/2001 | Carmichael et al. | |
| 7,134,505 | B2 * | 11/2006 | Fehr et al. | 166/387 |
| 2006/0207796 | A1 * | 9/2006 | Stewart | 175/57 |
| 2007/0039737 | A1 * | 2/2007 | Telfer | 166/311 |

FOREIGN PATENT DOCUMENTS

| | | | |
|---|---|---|---|
| GB | 2 327 963 | A | 2/1999 |
| WO | 2004/088091 | A1 | 10/2004 |
| WO | 2004/094779 | A1 | 11/2004 |

(Continued)

OTHER PUBLICATIONS

International Search Report issued in PCT/GB2009/050986, mailed on Feb. 17, 2010, 3 pages.

(Continued)

*Primary Examiner* — William P Neuder
(74) *Attorney, Agent, or Firm* — Osha Liang LLP

(57) ABSTRACT

A method of drilling and cleaning a wellbore while rotating the drill string after full drilling depth is reached without running the drill string out the bore to install a clean up work string is disclosed wherein a drill string having a drill bit at one end includes at least one near bit selectively activatable cleaning tool (10, 11, 12) mounted within the length of the drill string, said cleaning tool having a cleaning member (18) adapted to be moved from a close fitting stowed configuration within a recess (17) to a deployed configuration upon a body of the tool, wherein the cleaning member has magnets (19, 43) for use in positioning thereof, and compact tools for scraping, milling and brushing with improved resistance to ingress of detritus, debris and formation particulates are disclosed.

8 Claims, 3 Drawing Sheets

(56) References Cited

FOREIGN PATENT DOCUMENTS

| | | | |
|---|---|---|---|
| WO | 2005/106186 | A1 | 11/2005 |
| WO | 2006/016102 | A1 | 2/2006 |
| WO | 2006/120453 | A1 | 11/2006 |
| WO | 2007/003894 | A2 | 1/2007 |

OTHER PUBLICATIONS

Written Opinion issued in PCT/GB2009/050986, mailed on Feb. 17, 2010, 7 pages.

* cited by examiner 12
10
16
17
11

12
45
48
44
50
46
15
18
1
A→
19
5
4
41
43
40
42
13
14
11

48
42
52
50
46
16
14
19
15
43
1
B→
2
3
40
13

2
1

14

DRILL STRING MOUNTED ROTATABLE TOOL AND CLEANING METHOD

FIELD OF THE INVENTION

The present invention relates to drilling a borehole and provides drill string mounted rotatable tools and a method of cleaning the borehole during a drilling trip. In particular, but not exclusively, the present invention relates to a method of drilling and cleaning a wellbore without running the drill string out the bore to install a clean up work string.

BACKGROUND TO THE INVENTION

In the drilling and production of oil and gas wells, a well bore is drilled by means of a plurality of drill pipes provided in sufficient numbers to assemble a rotatable drill string sufficient to drill the required depth. The rotatable drill string is terminated by a drill bit and typically provided with stand-off stabiliser parts periodically throughout the length of the drill string. The drill string is rotated to remove formation ahead of the drill bit, to drill out and thus form a wellbore, and to increase the depth of the well. Drilling mud or other fluid is circulated through the drill string to cool, lubricate and clear the drill bit of cuttings, and to displace the resulting drill cuttings from the bottom of the well to the surface, via an annulus formed between the drill string and the wall of the wellbore.

Periodically, the drill bit is removed from the wellbore and a casing comprising lengths of tubular casing sections coupled together end-to-end is run into the drilled wellbore and cemented in place. A smaller dimension drill bit is then inserted through the cased wellbore, to drill through the formation below the cased portion, to thereby extend the depth of the well. A smaller diameter casing is then installed in the extended portion of the wellbore and also cemented in place. If required, a liner comprising similar tubular sections coupled together end-to-end may be installed in the well, coupled to and extending from the final casing section. Once the desired full depth has been achieved, the drill string is removed from the well and then a work string is run-in to clean the well. Once the well has been cleaned out, the walls of the tubular members forming the casing/liner are free of debris so that when screens, packers, gravel pack assemblies, liner hangers or other completion equipment is inserted into the well, an efficient seal can be achieved between these devices and the casing/liner wall.

The step of cleaning the wellbore is usually achieved by inserting a work string containing dedicated well clean-up or cleaning tools. Typical well cleaning tools known for use in this environment include scrapers, wipers and/or brushes which are held against the internal wall of the casing/liner, to clean away debris as the tool is run-in and then pulled out of the wellbore. While this process is effective in cleaning the wellbore, it adds a significant amount of time to the job of preparing the well for production, since a separate well clean-up string requires to be run in the bore after the drill string has been removed. Thus at least two trips are required, a drill string trip and a work string trip.

Additionally, the formation in the wellbore is left exposed during the intervening period whilst the drill string is pulled out the hole and during the clean-up operation, which is disadvantageous because it is known that problems may arise in leaving a formation exposed between drilling and completion of a well.

One known type of cleaning apparatus is disclosed in UK Patent Publication No. 2 327 963 (Appleton et al). GB 2 327 963 describes a work string combining a packer with a scraper. The scraper is used to clean the casing ahead of the packer so that the packer can be set against a debris free casing. While this method removes the requirement of running a separate clean-up string before the packer is inserted, such a string is limited in that the scraper can only clean a fixed distance ahead of the packer and, as a result, only a portion of the casing is cleaned. Also, any debris dislodged by the cleaning operation is pushed into the wellbore.

Another cleaning tool is described in WO 2006/016102 (Fitzgerald et al) which is intended for cleaning casing. The tool proposed therein has retracted cleaning scrapers for run in upon a drill string, which are extended under spring-loading only after drilling is stopped. When the bore hole has been extended sufficiently below the casing by drilling, the drill string is pulled out to locate the cleaning scraper within the casing where a liner hanger is to be located. A cleaning operation is then conducted upon the casing as the drill string is rotated and reciprocated. Having the cleaning scrapers retracted during drilling, allows the casing to be cleaned on the return trip of the drill string, and spring loading allows the cleaning scrapers to be extended for cleaning the casing.

It is found that when operating near bit tools in the open (no casing or liner) borehole, ingress of debris and formation particulates leads to problems with the tools.

It is amongst the objects of at least one embodiment of the present invention to obviate or mitigate at least one of the foregoing disadvantages.

It is also amongst the objects of at least one embodiment of the present invention to provide a method of drilling a well wherein the well may be selectively cleaned at any depth whilst the drill string is rotated in the wellbore.

SUMMARY OF THE INVENTION

According to a first aspect of the present invention, there is provided a method of drilling and cleaning a wellbore during a drilling trip, the method comprising the steps of:

a) providing a drill string having a drill bit at one end, and at least one cleaning tool mounted within the length of the drill string, wherein the cleaning tool comprises at least one selectively activatable cleaning member adapted to be moved from a stowed configuration to a deployed configuration upon a body of the tool, wherein the cleaning member has magnets for use in positioning thereof;

b) drilling a wellbore to a predetermined depth using the drill bit while retaining the cleaning members in the stowed configuration;

c) retrieving the drill bit from the predetermined depth and selectively activating the cleaning members during the return trip whilst rotating the drill string to conduct a cleaning step within the wellbore using the cleaning members in the deployed configuration, and optionally, d) reciprocating the drill string to enhance a cleaning operation using the cleaning members in the deployed configuration, to thereby clean the wellbore.

Preferably the cleaning members are retained in the stowed position by provision of magnets associated therewith, and utilisation of the said magnets to hold the cleaning members inboard against an inner part of the cleaning tool. The magnets are preferably chosen to offer sufficient retention to overcome centrifugal effects upon the cleaning element at drilling rotational speeds without requiring additional retention means or fasteners. Thus the magnets inhibit premature deployment of cleaning elements during a drilling operation.

Such an arrangement allows swift removal and replacement of cleaning element modules when the tool is being serviced.

The cleaning steps may be conducted whilst the drill string is being reciprocated within the wellbore. Optionally, the cleaning steps may be repeated whilst the rotating drill string is reciprocated at a controlled rate.

A person skilled in the art would take account of the location of the cleaning tool in the wellbore when exercising control of speed of rotation and rate of reciprocation, e.g. whether the tool was in open or cased or lined formation, and also take account of the nature of the cleaning element being used i.e. abrasive surfaces, scrapers, cutting edges, wiper blades, bristles/brushes.

The cleaning element may comprise a relatively hard, durable material, for example for use as an abrasive surface, or as a working face or edge of any tool element.

Optionally, where the cleaning operation requires scraping action, a relatively soft material may be used for forming the scraping edge of the tool. This is useful when the cleaning operation is to be conducted upon casing or liner where damage to casing surface for example could affect subsequent operation of packers or other subsequently run tools.

Where the cleaning operation requires a swept area, resilient bristles forming a brush element of a length greater than is estimated for contact with the wellbore surface during rotation of the drill may be utilised.

Where the cleaning operation involves a milling function, the cleaning element may have an abrasive material or abrasive elements e.g. a milling pad provided thereon.

Preferably the step of assembly of the drill string involves selection of a preferred order of connection of cleaning tools into the drill string reflecting a predetermined selected sequence of deployment of the tools. The inclusion of the cleaning tools may be by way of selected one or more of a plurality of sub assemblies ("sub") each of which is dedicated to one aspect of cleaning operations, e.g. each sub may be selected from a scraper tool, a milling tool, a brushing tool, a wiper tool, and optionally a jetting tool. A preferred combination may be a leading scraper tool and a following brush tool (tandem arrangement). These tools are preferably incorporated in the drill string near the bit.

Preferably each sub is provided with means for actuation that is discrete and independent of actuation of any other sub. However, the means of triggering an actuation event may be initiated by a single action, e.g. deployment of a single ball into a circulation fluid may be used to sequentially actuate a plurality of tools arranged within the drill string length.

Means for enabling this actuation by providing a temporary obturating functionality is described in our international patent application number WO 2005/106186 which is hereby incorporated by reference. In that application a ball valve seat is disclosed which provides a temporary seal for a plug. The valve seat comprises a substantially cylindrical body of a first volume, which defines a seating surface. A pressure differential is developed across the valve seat when the plug sealingly engages the seating surface. The body is formed of an elastic material which compresses from a first volume to a smaller second volume by application of a force on the plug, to provide a clearance which is greater than a plugging dimension of the plug, thus allowing passage of the plug downstream. After passage of the plug, the body returns to the first volume.

The method of the invention to be more particularly described herein may also include the step of ejecting the ball from the cleaning tool once the cleaning members are activated, and maintaining circulation through the drill string during the cleaning operation. This is achievable by providing no inhibition to passage of the ball when it has passed the seat after the actuation event. This is useful where it is required to sequentially actuate a tandem arrangement of tools within the drill string, so that the same ball actuates said tools in turn.

Alternatively, if the ball is to be delayed within the tool for a period of time before it is required to actuate a further downstream tool, then there may be provided a secondary deformable seat towards the pin end (downhole) of the tool. Such a seat may be located adjacent to by-pass ports and channels formed on the sleeve which permits circulation fluid to pass to ensure that circulation fluid flow is not completely obstructed. The secondary deformable seat would generally be more readily deformed than the first seat to allow quicker release.

Preferably the same basic sub and actuation mechanism is adopted in assembly of the drill string and successively arranged cleaning tools, with the only variations being to accommodate cleaning elements, which may be modular interchangeable elements. Thus in each tool sub there may be provided a breather valve for balancing internal and external pressures with respect to the tool, an axially displaceable actuation sleeve locatable within the tool by use of a shear fastener, said sleeve incorporating a seat for an obturator element, such as a ball, to form a valve combination that is designed to seal up to a predetermined applied fluid pressure that is sufficient to shear the fastener and permit sleeve displacement. The tool body includes a throughbore for passage of circulation fluid, which also accommodates the displaceable actuation sleeve, and provides an internal bore restriction that serves to limit the extent of displacement of the actuation sleeve. The bore restriction may be a non-deformable seat or a rigid shoulder. The sub may optionally include a ball catcher and fluid by-pass, or the drill string may include another downstream sub offering a ball catcher functionality. The drill string may also include a flow circulation control valve (CCV) such as our CENTURION®.

Thus, it has been found that the steps of drilling and cleaning whilst rotating a drill string may be achieved on a single trip into the wellbore, without compromising drilling objectives. The ability to rotate and reciprocate the cleaning tool sub using the drill string on the return trip allows a simpler and more compact cleaning sub design which also contributes to weight reduction since a lighter tool and lesser numbers thereof are required in the drill string.

The combined drilling and cleaning method may be implemented in all regions of the well bore including exposed i.e. open (uncased and unlined) as drilled bore by adopting compact cleaning tools wherein void or dead space is minimised such that the opportunity for debris or particulates to penetrate working parts of the tool is inhibited.

Thus according to another aspect of the invention there is provided a compact cleaning tool sub assembly for inclusion within a drill string, said tool sub assembly comprising an elongate body having box and pin ends for attachment to drill pipe, and at least one selectively activatable cleaning member adapted to be moved from a stowed configuration within the tool to a deployed configuration upon the body of the tool by actuator means, wherein the stowed configuration is within a recess provided in an upset region of the tool body, said recess configured to receive the cleaning element in a close fit, and the cleaning element is provided with an edge formation adapted to obstruct penetration of debris or particulates into movable parts of the tool during a drilling operation. The upper peripheral edge of the recess may be chamfered and the cleaning element may be provided with a lip configured to provide a complimentary fit therewith. Alternatively, the edge of the cleaning element may be configured to receive a resilient seal member sized and positioned to cooperate with the tool body to inhibit admission of debris or particulates into the recess.

The cleaning elements may be mounted within and deployed from a projecting formation upon the tool body, the surrounding tool body surface serving as a fluid flow by-pass channel on at least one side of the formation so that, for example, the circulation of fluid and cuttings up the annulus around the tool in the wellbore can be maintained.

The projecting formation may be a stabiliser portion or axially oriented rib or upset portion of the tool body.

A suitable arrangement of the cleaning elements would be to provide three radially spaced formations around the tool body which offers good cleaning functionality without inhibiting external fluid circulation past the tool.

Preferably the step of activating the cleaning member comprises providing a cam surface on an actuator sleeve located within the tool body, and displacing the actuator sleeve to cause the cleaning member to be deployed by contact with the cam surface.

The cam surface may be a ramp formed upon the actuator sleeve, and the actuator sleeve may be displaced along a longitudinal axis of the tool body to cause the cleaning member to be deployed radially from the tool body.

In a preferred embodiment of the invention, the sleeve is movable relative to the body between a first axial position in which the cleaning members are in their respective stowed configuration, and a further axial position in which the cleaning members are in their respective deployed configuration.

The actuator sleeve is preferably displaced by fluid pressure overcoming a shearable fastener holding the actuator sleeve in place within the tool body.

Optionally, the displaced actuator sleeve may be positively retained in the further axial position by means of a spring-loaded pin located in the tool body engaging a corresponding recess in the actuator sleeve.

Fluid pressure required to shear the fastener may be applied by introducing an obturating member, such as a ball, to circulating fluid, and providing a seat within the actuator sleeve, whereby circulating fluid carries the obturating member (e.g. ball) onto the seat to obstruct flow and cause a build up of fluid pressure.

Preferably the seat is formed from a deformable or compressible material which may be a thermoplastic polymer such as PEEK (polyetheretherketone), or another thermoplastic polymer with similar flexible properties. In this fashion, the seat may be deformed when a sufficient fluid pressure is exerted on the ball, which may cause deformation of the ball seat and passage of the ball through or past the seat. Following passage of the ball through or past the ball seat, the seat may thus return to its original, un-deformed dimensions. Alternatively, the ball may be deformable to achieve a similar "stop and go" pressure build up then release after the shearable fastener has yielded.

Preferably, at least one magnet is located within the actuator sleeve, such that upon displacement thereof, that magnet confronts the retaining magnets associated with the cleaning member(s) in a mutually repulsive mode thereby urging the cleaning members radially outwards.

Thus the cleaning members may be biased into contact with the wall of the wellbore by magnetic repulsion achieved by arranging the respective magnets in pole-to-pole opposition (S-S or N-N) such that, when the magnets are aligned in confrontation by movement of the actuator sleeve, the magnet on or in each cleaning member is urged outwardly, in turn urging the cleaning member into contact with the wellbore wall. This is particularly beneficial when the cleaning members are scrapers or more aggressive surfaces such as those required for milling.

According to another aspect of the invention, there is provided a cleaning tool sub assembly for inclusion within a drill string, said tool sub assembly comprising an elongate body having box and pin ends for attachment to drill pipe, and at least one selectively activatable cleaning member adapted to be moved from a stowed configuration to a deployed configuration upon the body of the tool by actuator means, wherein the cleaning member has magnets for use in positioning thereof.

The magnets may be the sole means of retention of the cleaning elements within the recess in the stowed configuration.

Retainer pins may be employed to limit movement of the cleaning element within the recess when in the deployed position.

Such a tool sub assembly avoids use of coil and leaf springs for positioning of the cleaning member(s) and thereby provides a compact cleaning tool wherein void or dead space is minimised such that the opportunity for detritus, debris or particulates to penetrate working parts of the tool is inhibited.

Additionally, the cleaning elements may be provided with edge formations adapted to cooperate with the tool body so as to obstruct penetration of debris or particulates into movable parts of the tool during a drilling operation. Thus a lip or rim formation is suitable and bevelled or chamfered edges are beneficial in this respect. Alternatively, the edge of the cleaning element may be configured to receive a resilient seal member sized and positioned to cooperate with the tool body to inhibit admission of debris or particulates into the recess.

Such cleaning elements may be formed from relatively soft materials whereby the edge formations are self-sharpening, particularly in the case where the cleaning element is a scraper.

In a preferred embodiment of the invention, the sleeve is movable relative to the body between a first axial position in which the cleaning members are in their respective stowed configuration, and a further axial position in which the cleaning members are in their respective deployed configuration.

The actuator sleeve may be initially positioned within the tool body by means of a shear fastener. The extent of displacement of the actuator sleeve after the shear fastener has yielded is determined by providing a limit stop within the through bore of the tool such as a width restriction, i.e. taper, or shoulder, or the like throughbore cross-sectional dimension restriction.

The actuation of the tool may be in accordance with the preferred features described with respect to the first aspect of the invention.

It will be understood that a wellbore is typically drilled to a first depth and, as described above, a casing is then installed in the wellbore and cemented in place. The present invention may have a particular utility in cleaning exposed formation surface within the open wall (uncased and unlined) wellbore near the operating bit, where detritus, debris and particulates typically cause problems for near bit tools.

According to a still further aspect of the invention, there is provided a drill string comprising a plurality of sub assemblies, each one of which comprises an elongate body having box and pin ends for attachment thereof within the drill string, and at least one selectively activatable cleaning member adapted to be moved from a stowed configuration to a deployed configuration upon the body of the tool by actuator means, wherein the cleaning member has magnets for use in positioning thereof, wherein the stowed configuration is within a recess provided in an upset region of the tool body, said recess configured to receive the cleaning element in a close fit, and the cleaning members comprise at least one of brush elements, scraper elements, and milling elements.

In one embodiment of the invention, a cleaning tool sub assembly comprises an elongate body having box and pin ends for attachment to drill pipe, said body having a throughbore, an axially displaceable actuation sleeve locatable within the throughbore in a first position by use of a shear fastener, said sleeve incorporating a seat for an obturator element, such as a ball, to form in use therewith a valve that is designed to block circulation fluid flow within the tool up to a predetermined applied fluid pressure that is sufficient to shear the fastener and permit sleeve displacement, said body having three external projecting formations mutually spaced radially around the body, and each having a recess for housing a cleaning element, a cleaning element mounted within said recess in a close fit therewith, said cleaning element having an exterior face provided with scraper edges, and an interior face containing magnets arranged to retain the cleaning element in a stowed configuration within the recess, the peripheral edges of said exterior face cooperating with a corresponding edge of the recess to inhibit ingress of debris or formation particulates into the tool, said interior face contacting a surface of the inner sleeve in its first position, said sleeve having an adjacent inclined cam surface adapted to confront the inner face of the cleaning element whenever the sleeve is displaced from its first position, whereby the cleaning element is caused to emerge radially through the recess to a deployed configuration, and said inclined cam surface incorporating a further magnet arranged such that when confronting the magnets in the inner face of the cleaning element the net effect is a repulsive effect that in use urges the cleaning element into contact with said well bore surface.

In a second embodiment of the invention, a cleaning tool sub assembly comprises an elongate body having box and pin ends for attachment to drill pipe, said body having a throughbore, an axially displaceable actuation sleeve locatable within the throughbore in a first position by use of a shear fastener, said sleeve incorporating a seat for an obturator element, such as a ball, to form in use therewith a valve that is designed to block circulation fluid flow within the tool up to a predetermined applied fluid pressure that is sufficient to shear the fastener and permit sleeve displacement, said body having three external projecting formations mutually spaced radially around the body, and each having a recess for housing a cleaning element, a cleaning element mounted within said recess in a close fit therewith, said cleaning element having an exterior face provided with abrasive material that is sufficiently aggressive to perform a milling function, and an interior face containing magnets arranged to retain the cleaning element in a stowed configuration within the recess, the peripheral edges of said exterior face cooperating with a corresponding edge of the recess to inhibit ingress of debris or formation particulates into the tool, said interior face contacting a surface of the inner sleeve in its first position, said sleeve having an adjacent inclined cam surface adapted to confront the inner face of the cleaning element whenever the sleeve is displaced from its first position, whereby the cleaning element is caused to emerge radially through the recess to a deployed configuration, and said inclined cam surface incorporating a further magnet arranged such that when confronting the magnets in the inner face of the cleaning element the net effect is a repulsive effect that in use urges the cleaning element into contact with said well bore surface. In alternative forms, the edge of the cleaning element may be configured to receive a resilient seal member sized and positioned to cooperate with the tool body to inhibit admission of debris or particulates into the recess.

In a third embodiment of the invention, a cleaning tool sub assembly comprises an elongate body having box and pin ends for attachment to drill pipe, said body having a throughbore, an axially displaceable actuation sleeve locatable within the throughbore in a first position by use of a shear fastener, said sleeve incorporating a seat for an obturator element, such as a ball, to form in use therewith a valve that is designed to block circulation fluid flow within the tool up to a predetermined applied fluid pressure that is sufficient to shear the fastener and permit sleeve displacement, said body having three external projecting formations mutually spaced radially around the body, and each having a recess for housing a cleaning element, a cleaning element mounted within said recess in a close fit therewith, said cleaning element having an exterior face provided with bristles to form a brush element, and an interior face containing magnets arranged to retain the cleaning element in a stowed configuration within the recess, said interior face contacting a surface of the inner sleeve in its first position, said sleeve having an adjacent inclined cam surface adapted to confront the inner face of the cleaning element whenever the sleeve is displaced from its first position, whereby the cleaning element is caused to emerge radially through the recess to a deployed configuration, and said bristles are of a length predetermined to be greater than is estimated for contact with the wellbore surface during rotation of the drill string.

The cleaning tool subs of the aforesaid first, second and third embodiments may optionally include a ball catcher and fluid by-pass, or the drill string may include another downstream sub offering a ball catcher functionality. The drill string may include a circulation control valve in conjunction with any of the aforesaid subs in a near bit position to protect the bottom hole assembly (BHA).

The sleeve may be mounted for axial and/or rotational movement relative to the body, to facilitate movement of the sleeve between the first and a second cleaning element deployment position.

The ball catcher (if present in the cleaning tool) may in the simplest case be a dimension restriction (or a non-deformable seat) within the bore of the sleeve and remote from the seat, with appropriately positioned ports or fluid bypass channels to permit circulation fluid to flow around the "caught" ball.

A separate sub bypass ball catcher (BBC) may comprise a substantially cylindrical body having first and second bores running in parallel therethrough, wherein a ball entering the catcher is directed into the first bore so that the second bore remains open for the continuous passage of fluid through the tool. Advantageously the second bore is centrally located and aligned with the axial bore, which may itself be a central bore.

A flow circulation control sub is described in our U.S. Pat. No. 6,253,861 and our international patent publication number WO2004088091, which are hereby incorporated by reference.

Such a flow circulation control sub comprises a body member connectable in or to a drill string and one or more valve members, the body member having a radial outlet associated with each valve member and an-axial bore providing passage for drilling fluid between an axial inlet and an axial outlet, and between the axial inlet and each radial outlet, wherein each valve member is moveable between a respective first position at which the associated radial outlet is in either one of an open or a closed state and a second position at which the associated radial outlet is an alternative closed or open state, and wherein the valve member allows for fluid flow through or at least partially through the axial bore when in either of the aforementioned position

BRIEF DESCRIPTION OF THE DRAWINGS

Embodiments of the present invention will now be described, by way of example only, with reference to the accompanying drawings, in which:

FIG. 1(*b*) is a longitudinal section of the cleaning sub shown in FIG. 1(*a*) wherein the actuator sleeve is held in a first position by a shear fastener and the scraper elements are in a stowed configuration, and;

FIG. 1(*c*) is a longitudinal section of the cleaning sub shown in FIG. 1(*a*) wherein the actuator sleeve is displaced from its first position and the scraper elements are in a deployed configuration;

FIG. 1(*d*) is an axial section about line A-A through the cleaning sub illustrated in FIG. 1(*b*) where the scraper elements are in a stowed configuration; and FIG. 1(*e*) is an axial section about line B-B through the cleaning sub illustrated in FIG. 1(*c*) where the scraper elements are in a deployed configuration;

FIG. 2(*b*) is a longitudinal section of the cleaning sub shown in FIG. 2(*a*) wherein the actuator sleeve is held in a first position by a shear fastener and the abrasive milling elements are in a stowed configuration, and;

FIG. 2(*c*) is a longitudinal section of the cleaning sub shown in FIG. 2(*a*) wherein the actuator sleeve is displaced from its first position and the abrasive milling elements are in a deployed configuration;

FIG. 2(*d*) is an axial section A-A through the cleaning sub illustrated in FIG. 2(*b*) where the abrasive milling elements are in a stowed configuration; and FIG. 2(*e*) is an axial section B-B through the cleaning sub illustrated in FIG. 2(*c*) where the abrasive milling elements are in a deployed configuration;

FIG. 3(*b*) is a longitudinal section of the cleaning sub shown in FIG. 3(*a*) wherein the actuator sleeve is held in a first position by a shear fastener and the bristle/brush elements are in a stowed configuration;

FIG. 3(*c*) is a longitudinal section of the cleaning sub shown in FIG. 3(*a*) wherein the actuator sleeve is displaced from its first position and the bristle/brush elements are in a deployed configuration;

FIG. 3(*d*) is an axial section A-A through the cleaning sub illustrated in FIG. 3(*b*) where the bristle/brush elements are in a stowed configuration; and FIG. 3(*e*) is an axial section B-B through the cleaning sub illustrated in FIG. 3(*c*) where the bristle/brush elements are in a deployed configuration;

MODES FOR CARRYING OUT THE INVENTION

Scraper Cleaning Tool Sub Assembly

Figures 1A, 1B, 1C, 1D, 1E:
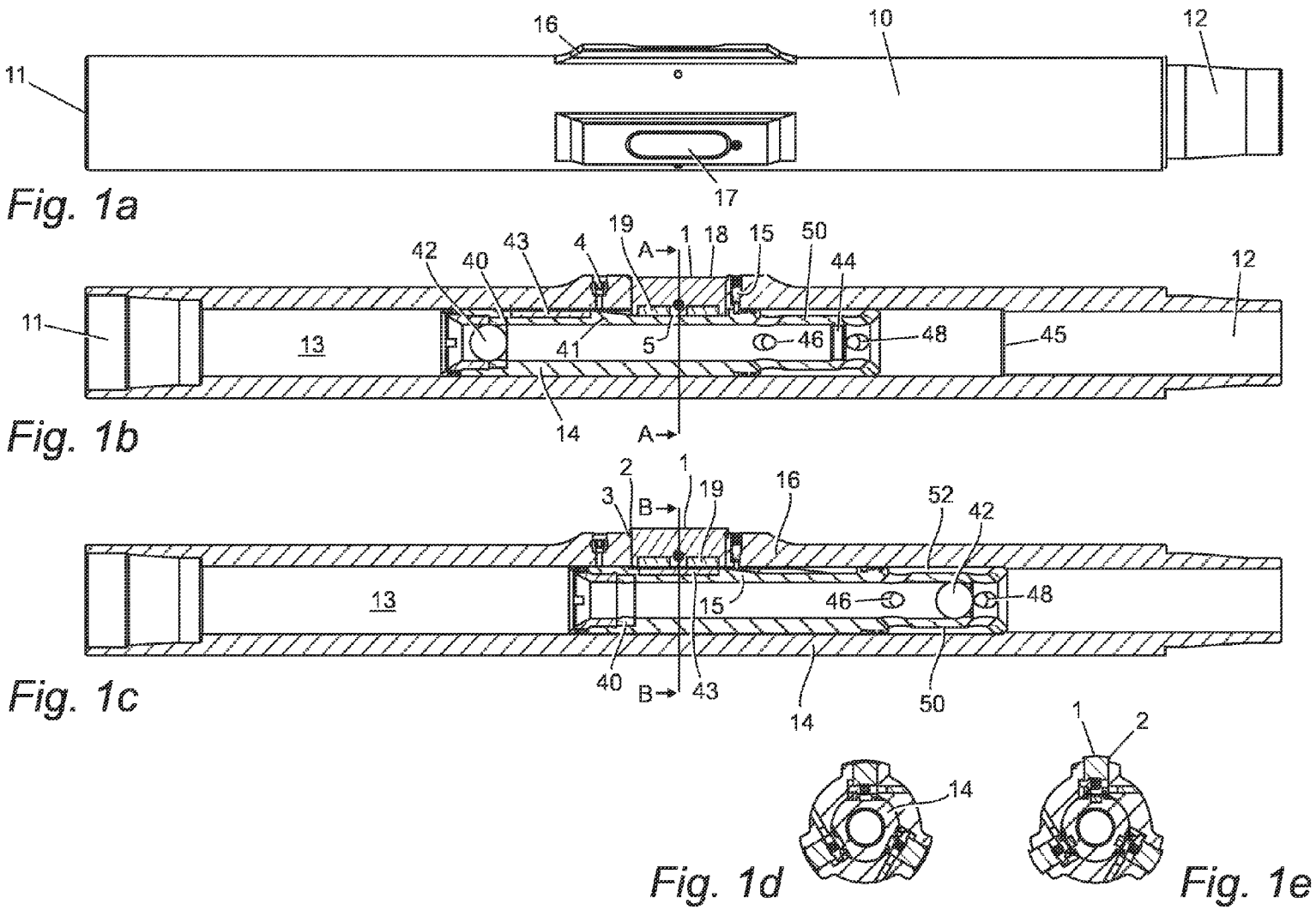
FIG. 1(*a*) is a side view of a cleaning sub adapted for insertion into a drill string, and comprising scraper elements.
Figure 2A:
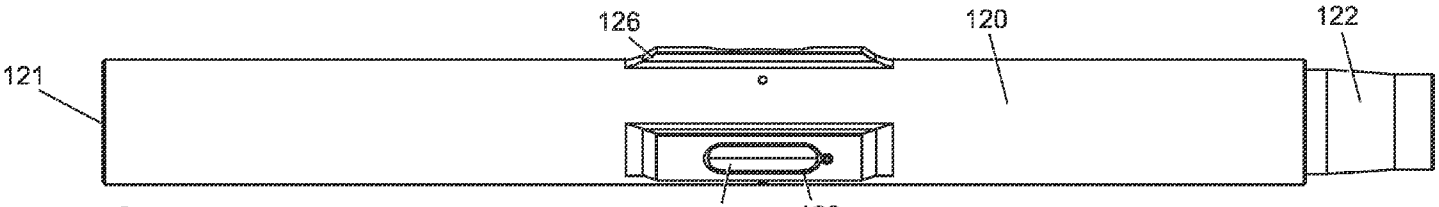
FIG. 2(*a*) is a side view of a cleaning sub adapted for insertion into a drill string, and comprising abrasive milling elements.
Figure 2B:
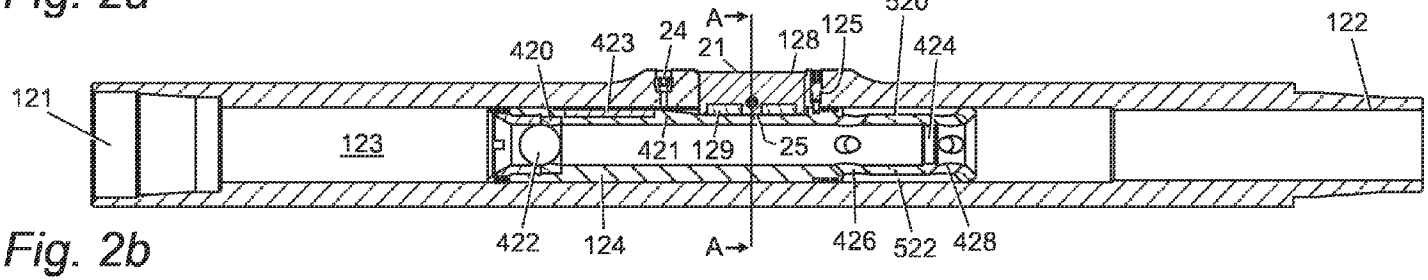
Figure 2C:
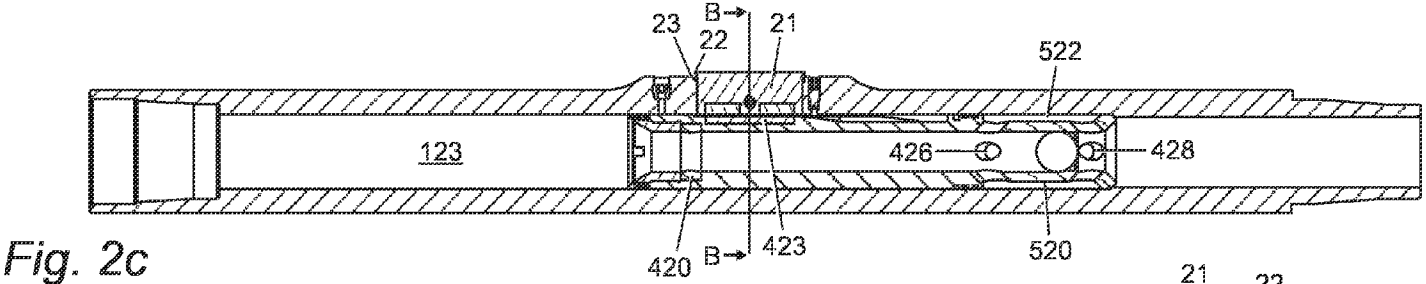
Figure 2E:
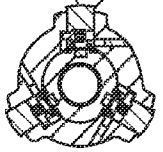
Figure 2D:
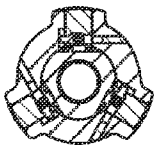
Figure 3A:
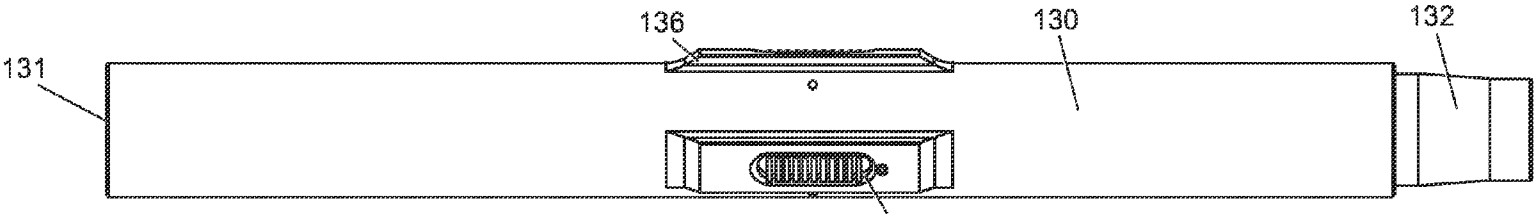
FIG. 3(*a*) is a side view of a cleaning sub adapted for insertion into a drill string, and comprising bristle/brush elements.
Figure 3B:
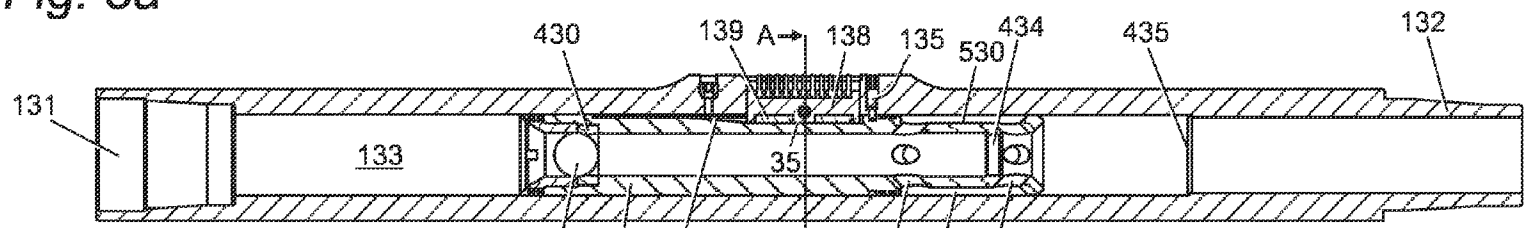
Figure 3C:
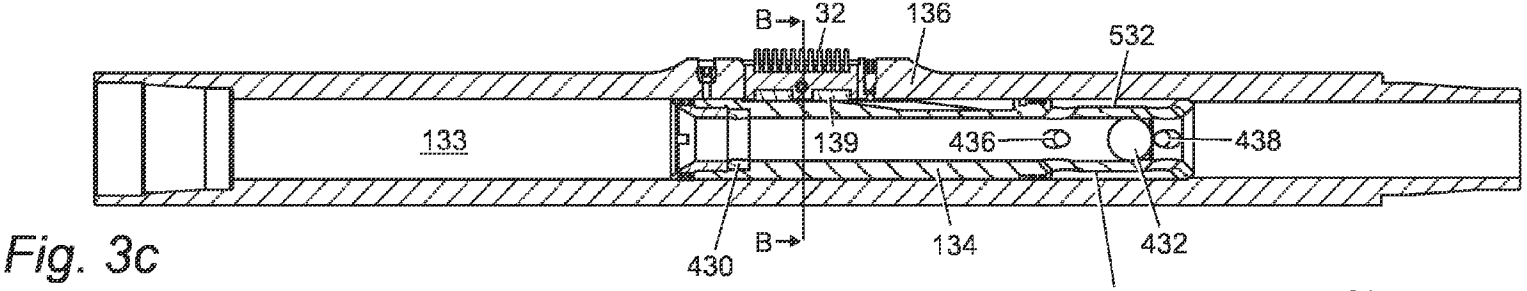
Figure 3D:
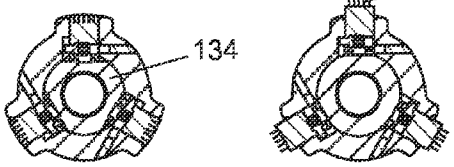
Figure 3E:
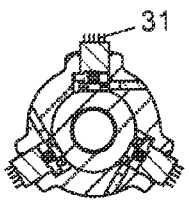

Referring to FIGS. 1(*a*) through (*e*), a cleaning sub assembly adapted for attachment to drill pipe (not shown) to form a drill string adapted to perform a clean up operation after drilling to the required well bore depth is achieved comprises a sub body 10, having box and pin ends (11, 12 respectively), a throughbore 13, an axially displaceable sleeve 14, retained in a first position within the throughbore by a shear fastener 15, and external upset stabiliser formations 16, wherein a recess 17 provides a housing for a scraper cleaning element 18 provided with magnets 19 for retaining the scraper element in a stowed configuration against the sleeve 14.

The sleeve 14 serves as an actuator for deploying the scraper cleaning elements 18. This capability is enabled by use of the circulation fluid required for drilling operations, and provision of a deformable seat 40 at one end of the sleeve 14, that is adapted to restrain a ball shaped obturator 42, for a period of time determined by the pressure developed upon the seated ball by circulation fluid. This pressure is predetermined to exceed the shear limit of the shear fastener 15, before allowing the ball 42 to pass the seat 40. A reduced diameter seat 44 at the other end of the sleeve serves as a "ball catcher" in this embodiment.

Ports 46, 48, in the sleeve 14 together with reduced external diameter surface 50 serve to provide a by-pass channel 52 for circulation fluid to flow around the "caught ball" and allow circulation to continue.

A breather valve 4 is provided in the body 10 (here in the upset formation 16) for pressure equalisation.

The sleeve 14 is configured to provide a cam surface 41 adjacent to the recess 17 housing the scraper cleaning element 18 that is in contact with the sleeve.

The scraper cleaning element 18 is adapted to fit closely into the recess 17, and has an exterior surface 1 with peripheral edges 2 that overlie chamfered edges 3 around the exterior of the recess 17 in order to inhibit ingress of debris or formation particulates in use. The interior surface 5 incorporating the magnets 19 lies flush against the sleeve 14. A small amount of packing grease or the like may be included in the base of the recess 17 against the sleeve 14.

Upon shearing of the shear fastener the resulting displacement of the sleeve 14 under circulation fluid pressure causes the interior surface 5 of the scraper cleaning element to contact and ride up the cam surface 41, that in turn forces the exterior surface 1 of the scraper cleaning element to emerge radially outwardly from the recess 17, to a deployed configuration exposing the scraper edges 2 for use in a cleaning operation.

The sleeve 14 in this embodiment incorporates a magnet 43 that is so arranged that, whilst the sleeve 14 is in its first position, the magnet 43 has no effect. However, when the shear fastener 15 is disengaged and the sleeve 14 is displaced from its first position, the magnet 43 is brought into confrontation with the magnets 19 in the scraper cleaning element interior surface 5, the net effect of which (due the opposed juxtaposition of like magnetic poles) is a repulsion between the magnet 43 and the magnets 19 that urges the scraper elements into contact with a surface of the wellbore that requires cleaning.

The magnets used here are made of samarium cobalt, though other materials with suitable properties may be selected.

The ball seat 40 within the sleeve 14 is preferably one such as is described in our publication WO2005106186. In this embodiment the ball seat 40 is elastically deformable, and is typically made of a material such as PEEK (polyetheretherketone). It will be recognised, however, that other polymeric materials with suitable elastic properties could be utilised. A suitable material for the ball 42 is steel, or any hard material that is sufficient to translate the applied fluid pressure build up into deformation energy to permit the ball to pass the seat 40.

In alternative embodiments, the seat is not elastically deformable, but the ball-shaped obturator element is elastically deformable to achieve a similar circulation fluid pressure build up followed by dissipation thereof upon passage of the ball.

The elasticity of the deformable material should be such as to permit pressure build up to a value exceeding the shear limit of the shear fastener 15 to cause the sleeve 14 to be displaced to actuate the deployment of the scraper cleaning element.

In use, the tool 10 is connected to a drill string (not shown) using the box section 11 and pin section 12.

As shown in FIG. 1(*b*), in the first position of the sleeve 14, the scraper cleaning elements are initially recessed, closely fitting just below the outer surface of the upset formation 16, and closing off the recess 17. The scraper cleaning elements 18 in this stowed configuration thus do not interfere with the running of the drill string incorporating the tool and so do not compromise the drilling operation. Furthermore, ingress of detritus, debris or formation particulates is inhibited.

During drilling, circulation fluid ("mud") is circulated through the bore 13 to the drill bit, and returns up the annulus defined around the drill string within the wellbore surface.

When a sufficient drill depth has been reached for the wellbore, a cleaning operation can be conducted before running the drill string out of the wellbore.

In order to deploy the scraper cleaning elements 18 a ball 42 (or other plug) is introduced to the circulation fluid topside and conveyed thereby through the drill string until contact with the seat 40. The throughbore 13 is thereby obstructed and pressure applied to the sleeve 14 though the seat 40 rises until the shear fastener shear limit is exceeded, whereupon the sleeve 14 is displaced downstream from its first position to a reduced diameter limit stop 45 within the tool body 10.

During the displacement of the sleeve 14, the cam surface 41 engages the interior surface 5 of the scraper cleaning element 18 and causes the exterior surface 1 to emerge exposing the scraper cleaning element edges 2. Further displacement brings the magnet 43 into register in a confronting relationship with the magnets 19 in the interior surface of the scraper cleaning element. The ensuing repulsive forces upon the scraper cleaning element urges the deployed scraper cleaning element edges into contact with a wellbore surface to be cleaned.

At the same time, as pressure increases on the ball 42, it is blown through the ball seat 40, by compression of the ball seat within its own volume, and the ball seat then returns to its original, undeformed configuration.

In this embodiment the ball is caught within the tool body 10, at reduced internal diameter seat 44. However, where several tools are used in tandem, it would be desirable to position a ball catcher further downstream but before the BHA to collect the or each ball utilised in a tool actuation event.

Any suitable ball catcher may be used. An example of one is given in our international publication WO 2004/094779. This ball catcher provides a side path for the balls to be retained while maintaining a central clearance bore through the tool for the passage of fluid and/or other tools.

Milling Pad Cleaning Tool Sub Assembly

Referring to FIGS. 2(*a*) through (*e*), a cleaning sub assembly adapted for attachment to drill pipe (not shown) to form a drill string adapted to perform a clean up operation after drilling to the required well bore depth is achieved comprises a sub body 120, having box and pin ends (121, 122 respectively), a throughbore 123, an axially displaceable sleeve 124, retained in a first position within the throughbore by a shear fastener 125, and external upset stabiliser formations 126, wherein a recess 127 provides a housing for a milling pad element 128 provided with magnets 129 for retaining the milling pad element in a stowed configuration against the sleeve 124.

The sleeve 124 serves as an actuator for deploying the milling pad cleaning elements 128. This capability is enabled by use of the circulation fluid required for drilling operations, and provision of a deformable seat 420 at one end of the sleeve 124, that is adapted to restrain a ball shaped obturator 422, for a period of time determined by the pressure developed upon the seated ball by circulation fluid. This pressure is predetermined to exceed the shear limit of the shear fastener 125, before allowing the ball 422 to pass the seat 420. A reduced diameter seat 424 at the other end of the sleeve serves as a "ball catcher" in this embodiment.

Ports 426, 428, in the sleeve 124 together with reduced external diameter surface 520 serve to provide a by-pass channel 522 for circulation fluid to flow around the "caught ball" and allow circulation to continue.

A breather valve 24 is provided in the body 120 (here in the upset formation 126) for pressure equalisation.

The sleeve 124 is configured to provide a cam surface 421 adjacent to the recess 127 housing the milling pad cleaning element 128 that is in contact with the sleeve.

The milling pad cleaning element 128 is adapted to fit closely into the recess 127, and has an exterior surface 21 with peripheral edges 22 that overlie chamfered edges 23 around the exterior of the recess 127 in order to inhibit ingress of debris or formation particulates in use. The interior surface 25 incorporating the magnets 129 lies flush against the sleeve 124. A small amount of packing grease or the like may be included in the base of the recess 127 against the sleeve 124.

Upon shearing of the shear fastener the resulting displacement of the sleeve 124 under circulation fluid pressure causes the interior surface 25 of the milling pad cleaning element to contact and ride up the cam surface 421, that in turn forces the exterior surface 21 of the milling pad cleaning element to emerge radially outwardly from the recess 127, to a deployed configuration exposing the milling pad edges 22 for use in a cleaning operation.

The sleeve 124 in this embodiment incorporates a magnet 423 that is so arranged that, whilst the sleeve 124 is in its first position, the magnet 423 has no effect. However, when the shear fastener 125 is disengaged and the sleeve 124 is displaced from its first position, the magnet 423 is brought into confrontation with the magnets 129 in the milling pad cleaning element interior surface 25, the net effect of which (due the opposed juxtaposition of like magnetic poles) is a repulsion between the magnet 423 and the magnets 129 that urges the milling pad elements 128 into contact with a surface of the wellbore that requires cleaning.

The magnets used here are made of samarium cobalt, though other materials with suitable properties may be selected.

The ball seat 420 within the sleeve 124 is preferably one such as is described in our publication WO2005106186. In this embodiment the ball seat 420 is elastically deformable, and is typically made of a material such as PEEK (polyetheretherketone). It will be recognised, however, that other polymeric materials with suitable elastic properties could be utilised. A suitable material for the ball 422 is steel, or any hard material that is sufficient to translate the applied fluid pressure build up into deformation energy to permit the ball to pass the seat 420.

In alternative embodiments, the seat is not elastically deformable, but the ball-shaped obturator element is elastically deformable to achieve a similar circulation fluid pressure build up followed by dissipation thereof upon passage of the ball.

The elasticity of the deformable material should be such as to permit pressure build up to a value exceeding the shear limit of the shear fastener 15 to cause the sleeve 14 to be displaced to actuate the deployment of the milling pad cleaning element.

In use, the tool 120 is connected to a drill string (not shown) using the box section 121 and pin section 122.

As shown in FIG. 2(*b*), in the first position of the sleeve 124, the milling pad cleaning elements sit just below the outer surface of the upset formation 126, within and closing off the recess 127. The milling pad cleaning elements 128 in this stowed configuration thus do not interfere with the running of the drill string incorporating the tool and so do not compromise the drilling operation. Furthermore, ingress of detritus, debris or formation particulates is inhibited.

During drilling, circulation fluid ("mud") is circulated through the bore 123 to the drill bit, and returns up the annulus defined around the drill string within the wellbore surface.

When a sufficient drill depth has been reached for the wellbore, a cleaning operation can be conducted before running the drill string out of the wellbore.

In order to deploy the milling pad cleaning elements 128 a ball 422 (or other plug) is introduced to the circulation fluid topside and conveyed thereby through the drill string until contact with the seat 420. The throughbore 123 is thereby obstructed and pressure applied to the sleeve 124 though the seat 420 rises until the shear fastener shear limit is exceeded, whereupon the sleeve 124 is displaced downstream from its first position to a reduced diameter limit stop 425 within the tool body 120.

During the displacement of the sleeve 124, the cam surface 421 engages the interior surface 25 of the milling pad cleaning element 18 and causes the exterior surface 21 to emerge exposing the milling pad cleaning element edges 22. Further displacement brings the magnet 423 into register in a confronting relationship with the magnets 129 in the interior surface of the milling pad cleaning element. The ensuing repulsive forces upon the milling pad cleaning element urges the deployed milling pad cleaning element edges into contact with a wellbore surface to be cleaned.

At the same time, as pressure increases on the ball 422, it is blown through the ball seat 420, by compression of the ball seat within its own volume, and the ball seat then returns to its original, un-deformed configuration.

In this embodiment the ball is caught within the tool body 120, at reduced internal diameter seat 424. However, where several tools are used in tandem, it would be desirable to position a ball catcher further downstream but before the BHA to collect the or each ball utilised in a tool actuation event.

Any suitable ball catcher may be used. An example of one is given in our international publication WO 2004/094779. This ball catcher provides a side path for the balls to be retained while maintaining a central clearance bore through the tool for the passage of fluid and/or other tools.

Brush Cleaning Tool Sub Assembly

Referring to FIGS. 3(*a*) through (*e*), a cleaning sub assembly adapted for attachment to drill pipe (not shown) to form a drill string adapted to perform a clean up operation after drilling to the required well bore depth is achieved comprises a sub body 130, having box and pin ends (131, 132 respectively), a throughbore 133, an axially displaceable sleeve 134, retained in a first position within the throughbore by a shear fastener 135, and external upset stabiliser formations 136, wherein a recess 137 provides a housing for a brush cleaning element 138 provided with magnets 139 for retaining the brush cleaning element 138 in a stowed configuration against the sleeve 134.

The sleeve 134 serves as an actuator for deploying the brush cleaning elements 138. This capability is enabled by use of the circulation fluid required for drilling operations, and provision of a deformable seat 430 at one end of the sleeve 134, that is adapted to restrain a ball shaped obturator 432, for a period of time determined by the pressure developed upon the seated ball by circulation fluid. This pressure is predetermined to exceed the shear limit of the shear fastener 135, before allowing the ball 432 to pass the seat 430. A reduced diameter seat 434 at the other end of the sleeve serves as a "ball catcher" in this embodiment.

Ports 436, 438, in the sleeve 134 together with reduced external diameter surface 530 serve to provide a by-pass channel 532 for circulation fluid to flow around the "caught ball" and allow circulation to continue.

A breather valve 234 is provided in the body 130 (here in the upset formation 136) for pressure equalisation.

The sleeve 134 is configured to provide a cam surface 431 adjacent to the recess 137 housing the brush cleaning element 138 that is in contact with the sleeve.

The brush cleaning element 138 is adapted to fit closely into the recess 137, in order to inhibit ingress of debris or formation particulates in use. The interior surface 35 incorporating the magnets 139 lies flush against the sleeve 134. A small amount of packing grease or the like may be included in the base of the recess 137 against the sleeve 134.

Upon yielding of the shear fastener the resulting displacement of the sleeve 134 under circulation fluid pressure causes the interior surface 35 of the brush cleaning element 138 to contact and ride up the cam surface 431, that in turn forces the exterior surface 231 of the brush cleaning element to emerge radially outwardly from the recess 137, to a deployed configuration exposing the bristles 32 of the brush cleaning element 138 for use in a cleaning operation.

The length of the bristles 32 is such as to exceed the predetermined average length required to contact the bare wall of the wellbore (or casing or liner). This means that during application of the brush cleaning element 138, in forcing longer bristles than is necessary for bare contact with the wall, distorts the bristles 32 into a curved tip and applies contact pressure to the surface to enhance brushing effect. This modification makes it unnecessary to utilise an additional magnet in the actuator sleeve 134.

The magnets used here for retention of the brush cleaning element 138 in the stowed configuration during drilling are made of samarium cobalt, though other materials with suitable properties may be selected.

The ball seat 430 within the actuator sleeve 134 is preferably one such as is described in our publication WO2005106186. In this embodiment the ball seat 430 is elastically deformable, and is typically made of a material such as PEEK (polyetheretherketone). It will be recognised, however, that other polymeric materials with suitable elastic properties could be utilised. A suitable material for the ball 432 is steel, or any hard material that is sufficient to translate the applied fluid pressure build up into deformation energy to permit the ball to pass the seat 430.

In alternative embodiments, the seat is not elastically deformable, but the ball-shaped obturator element is elastically deformable to achieve a similar circulation fluid pressure build up followed by dissipation thereof upon passage of the ball.

The elasticity of the deformable material should be such as to permit pressure build up to a value exceeding the shear limit of the shear fastener 135 to cause the sleeve 134 to be displaced to actuate the deployment of the brush cleaning element 138.

In use, the tool 130 is connected to a drill string (not shown) using the box section 131 and pin section 132.

As shown in FIG. 3(*b*), in the first position of the sleeve 134, the brush cleaning elements are recessed in a stowed configuration and the tips thereof are substantially level with the outer surface of the upset formation 136, closing off the recess 137. The scraper cleaning elements 138 in this stowed configuration thus do not interfere with the running of the drill string incorporating the tool and so do not compromise the drilling operation. Furthermore, due to the close fit of the brush cleaning element 138 within the recess, ingress of detritus, debris or formation particulates is inhibited.

During drilling, circulation fluid ("mud") is circulated through the bore 133 to the drill bit, and returns up the annulus defined around the drill string within the wellbore surface.

When a sufficient drill depth has been reached for the wellbore, a cleaning operation can be conducted before running the drill string out of the wellbore.

In order to deploy the brush cleaning elements 138 a ball 432 (or other plug) is introduced to the circulation fluid topside and conveyed thereby through the drill string until contact with the seat 430. The throughbore 133 is thereby obstructed and pressure applied to the actuator sleeve 134 though the seat 430 rises until the shear fastener yield limit is exceeded, whereupon the sleeve 134 is displaced downstream from its first position to a reduced diameter limit stop 435 within the tool body 130.

During the displacement of the sleeve 134, the cam surface 431 engages the interior surface 35 of the brush cleaning element 138 and causes the exterior surface 31 to emerge exposing the bristle tips 32. Further displacement distorts the bristle tips 32 into a curve that urges the bristles into contact with a wellbore surface to be cleaned.

At the same time, as pressure increases on the ball 432, it is blown through the ball seat 430, by compression of the ball seat within its own volume, and the ball seat then returns to its original, undeformed configuration.

In this embodiment the ball is caught within the tool body 130, at reduced internal diameter seat 434. However, where several tools are used in tandem, it would be desirable to position a ball catcher further downstream but before the BHA to collect the or each ball utilised in a tool actuation event.

Any suitable ball catcher may be used. An example of one is given in our international publication WO 2004/094779. This ball catcher provides a side path for the balls to be retained while maintaining a central clearance bore through the tool for the passage of fluid and/or other tools.

It will be appreciated that although the description for convenience may refer to relative positions as being "above" or "below", "up" or "down" and terms such as "upstream" and "downstream" have been used, the tool and method presented in the present invention can equally be used in horizontal and inclined well bores and is not restricted to vertical boreholes.

A principal advantage of the present invention is that it provides an improved method of drilling and cleaning a wellbore on a single trip into a wellbore. A further advantage of the present invention is that in performing the single trip, it does not leave the formation of the wellbore exposed for an excessive length of time, as would be required if a second trip was needed into the wellbore. The modified compact tooling described herein offers a more reliable cleaning operation with improved resistance to interference from debris and formation particulates.

Various modifications may be made to the invention herein described without departing from the scope thereof.

For example, whilst the drill string is described as being rotated (from surface) to drive and rotate the drill bit, it will be understood that the drill string may comprise a downhole motor such as a PDM or a turbine for driving the bit.

The magnet on the sleeve, used for urging the cleaning members to their activated positions, may be annular in shape; alternatively, a number of separate, arcuate magnets may be provided.

The invention claimed is:

1. A cleaning tool comprising:

an elongate body having box and pin ends for attachment to drill pipe; and at least one selectively activatable cleaning member adapted to be moved from a stowed configuration to a deployed configuration upon the body of the tool by an axially displaceable actuation sleeve secured in a first axial position by a shear fastener, the at least one selectively activatable cleaning member provided with edge formations configured to cooperate with the tool body so as to obstruct penetration of debris or particulates into the tool during a drilling operation, wherein the cleaning member has magnets for use in positioning thereof, wherein the edge formations include a seal configured to cooperate with the tool body so as to inhibit penetration of debris or particulates into movable parts of the tool during a drilling operation.

2. A cleaning tool assembly as claimed in claim 1, wherein the magnets are the sole means of retention of the at least one selectively activatable cleaning member within a recess in the stowed configuration.

3. The cleaning tool assembly of claim 1, further comprising a seat formed within the actuator sleeve, the seat having a reduced internal diameter configured to capture a hall.

4. The cleaning tool assembly of claim 3, wherein circulation fluid how within the cleaning tool is blocked when the ball is captured by the seat resulting in an increase in applied fluid pressure sufficient to shear the shear fastener and displace the actuator sleeve from the first axial position to a second axial position.

5. A cleaning tool assembly comprising:

an elongate body having box and pin ends for attachment to drill pipe, and at least one selectively activatable cleaning member adapted to be moved from a stowed configuration within the tool to a deployed configuration upon the body of the tool by actuator means, wherein the stowed configuration is within a recess provided in an upset region of the body of the tool, said recess configured to receive the at least one selectively activatable cleaning member in a close fit, and the at least one selectively activatable cleaning member is provided with an edge formation configured to obstruct penetration of debris or particulates into movable parts of the tool during a drilling operation, wherein the actuator means comprises an axially displaceable actuation sleeve locatable within a throughbore formed through the body, wherein the sleeve is secured in a first axial position by a shear fastener, and wherein an upper peripheral edge of the recess is chamfered and the at least one selectively activatable cleaning member is provided with a lip configured to provide a complimentary fit therewith.

6. A cleaning tool assembly as claimed in claim 5, wherein the sleeve incorporates a seat to receive an obturator element to form in use therewith a valve to block circulation fluid flow within the tool up to a predetermined applied fluid pressure that is sufficient to shear the fastener and permit displacement of the sleeve to a second axial position downstream from the first axial position to a reduced diameter limit stop within the body of the tool.

7. A cleaning tool assembly as claimed in claim 6, wherein a ball is captured upon a reduced internal diameter seat within the sleeve, and the sleeve has outlets connected by a sleeve surface channel to permit fluid bypass around the captured ball upon said reduced internal diameter seat.

8. A cleaning tool assembly as claimed in claim 7, wherein the seat upon which the ball is captured is a deformable seat allowing the ball to be released again after a predetermined delay as a result of fluid pressure upon the captured hall.

* * * * *